US007876271B2

(12) United States Patent
Nakanishi et al.

(10) Patent No.: US 7,876,271 B2
(45) Date of Patent: Jan. 25, 2011

(54) ANTENNA UNIT AND PORTABLE RADIO APPARATUS

(75) Inventors: Hideo Nakanishi, Yokohama (JP); Takashi Aoki, Kadoma (JP)

(73) Assignee: Panasonic Corporation, Osaka (JP)

( * ) Notice: Subject to any disclaimer, the term of this patent is extended or adjusted under 35 U.S.C. 154(b) by 752 days.

(21) Appl. No.: 11/816,913

(22) PCT Filed: Feb. 23, 2006

(86) PCT No.: PCT/JP2006/303308

§ 371 (c)(1),
(2), (4) Date: Aug. 22, 2007

(87) PCT Pub. No.: WO2006/090793

PCT Pub. Date: Aug. 31, 2006

(65) Prior Publication Data

US 2009/0051603 A1 Feb. 26, 2009

(30) Foreign Application Priority Data

Feb. 23, 2005 (JP) ..... P2005-047487

(51) Int. Cl.
*H01Q 1/24* (2006.01)

(52) U.S. Cl. ..... 343/702

(58) Field of Classification Search ..... 343/702, 343/700 MS

See application file for complete search history.

(56) References Cited

U.S. PATENT DOCUMENTS

| | | | | |
|---|---|---|---|---|
| 6,154,177 | A * | 11/2000 | Saito et al. | 343/702 |
| 7,626,554 | B2 * | 12/2009 | Mashima et al. | 343/702 |
| 7,659,855 | B2 * | 2/2010 | Mashima et al. | 343/702 |
| 2007/0164913 | A1 * | 7/2007 | Sakamoto et al. | 343/702 |
| 2008/0106477 | A1 * | 5/2008 | Mashima et al. | 343/702 |

FOREIGN PATENT DOCUMENTS

| | | | |
|---|---|---|---|
| EP | 1266425 | B1 | 12/2002 |
| JP | 08-186420 | A | 7/1996 |
| JP | 11-308030 | A | 11/1999 |
| JP | 11-330830 | A | 11/1999 |
| JP | 2000-158923 | A | 6/2000 |
| JP | 2001-326582 | A | 11/2001 |
| JP | 2003-163732 | A | 6/2003 |
| JP | 2003-204281 | A | 7/2003 |
| JP | 2004-032272 | A | 1/2004 |
| JP | 2004-096341 | A | 3/2004 |
| JP | 2004-208208 | A | 7/2004 |

* cited by examiner

*Primary Examiner*—Huedung Mancuso
(74) *Attorney, Agent, or Firm*—Seed IP Law Group PLLC

(57) ABSTRACT

In a portable radio apparatus, the antenna performance is improved while fitting conductor elements into an inside of a case without an increase in size of the case when two cases are closed. A monopole antenna arranged in an inside of a first case of a portable radio apparatus includes an element 11 on the power feed side, an element 12 on the open end side, and a resonance circuit 13. A width of the element 12 on the open end side, which comes close to an electronic parts 10 arranged in an inside of a second case and containing a metal in a folded mode, is set smaller than a width of the element 11 on the power feed side, which does not come close to the electronic parts 10.

15 Claims, 8 Drawing Sheets

ANTENNA UNIT AND PORTABLE RADIO APPARATUS

TECHNICAL FIELD

The present invention relates to a two-case type portable radio apparatus having two cases and, more particularly, a portable radio apparatus capable of obtaining the good antenna characteristic even when two cases are closed and an antenna unit for use in this portable radio apparatus.

BACKGROUND ART

As the two-case type portable radio apparatus in the prior art, the folding portable radio apparatus in which the antenna formed of a plate-like conductor is connected to an end portion of the first circuit board in the first case on the opposite side to the hinge portion that joins relatively movably the first case and the second case is known.

FIGS. 10(*a*),(*b*) are views showing a configuration of the portable radio apparatus in the prior art, and only a pertinent portion is shown herein. In FIGS. 10(*a*)(*b*), 2 is a first circuit board arranged in a first case 1, and a monopole antenna 6 formed of the above plate-like conductor is connected to an end portion of the first circuit board 2.

According to such portable radio apparatus, when an electronic parts 10 containing a built-in metal exists in a second case 3, a space in which no neighboring metallic substance is provided around the monopole antenna 6 must be created by expanding the first case 1 toward the opposite side to a hinge 5 along the longitudinal direction, as shown in FIGS. 11(*a*)(*b*), to ensure an operation of the monopole antenna 6 fitted to the first circuit board 2, and thus the antenna characteristic must be attained.

Also, as another two-case type portable radio apparatus in the prior art, as shown in FIGS. 12(*a*)(*b*), the folding portable radio apparatus in which the monopole antenna is provided to an end portion of the first circuit board 2 in the first case 1 on the opposite side to the hinge 5, which joins the first case 1 and the second case 3 turnably, and a resonance circuit 13 for cutting off a predetermined frequency is provided in the middle of the element has been proposed.

Such portable radio apparatus in the prior art is constructed as follows. The monopole antenna connected to an end portion of the first circuit board 2 is constructed by an element 11 and an element 12, the resonance circuit 13 for cutting off a predetermined frequency is provided in the middle, and the antenna having the impedance every frequency band is constructed.

In such portable radio apparatus, since a resonance band can be extended in addition to the resonance band obtained by the portable radio apparatus in FIG. 10 and FIG. 11, a multi-band radio communication utilizing different frequency bands can be accomplished. However, when the electronic parts 10 containing the built-in metal exists in the second case, a space in which no neighboring metal is provided around the element 11 and the element 12 must be created by expanding the first case 1 toward the opposite side to a hinge 5 along the longitudinal direction, as shown in FIGS. 13(*a*)(*b*), and thus the antenna characteristic must be attained.

DISCLOSURE OF THE INVENTION

Problems that the Invention is to Solve

In the portable radio apparatus shown in FIG. 10 and FIG. 12 in the prior art, an inner space of the first case 1 in which the elements 6, 11, 12 are arranged must be expanded as shown in FIG. 11 and FIG. 13 to prevent a reduction in the antenna performance caused when the electronic parts 10 containing the metal as the neighboring substance in the second case 3 in the closed state comes close to the monopole antenna 6 in FIG. 10 or the element 11 and the element 13 in FIG. 12. Therefore, for the portable radio apparatus a further reduction in size of which is sought, provision of another space in the first case 1 yields an extension of length of the first case 1, and also a length of the first case 1 becomes longer than a length of the second case 3. As a result, there is such a drawback that a total length is increased not only to lose the portability but also to worsen the design property.

The present invention has been made in view of the above circumstances, and provides a portable radio apparatus capable of preventing a reduction in the antenna performance without provision of a space that is created to eliminate a metallic substance from the neighborhood of the antenna when a case is folded or change of the antenna position, and also capable of fitting conductor elements constituting the antenna into the inside of the case not to increase a size of the case. Also, the present invention provides an antenna unit used to realize such portable radio apparatus.

Means for Solving the Problems

A portable radio apparatus of the present invention includes a first case; a second case; a joining portion for joining the first case and the second case relatively movably; a circuit board provided to an inside of the first case; and a monopole antenna having a resonance circuit, which is connected to the circuit board and cuts off a predetermined frequency, in a middle in a longitudinal direction; wherein a width of the second antenna element on an open end side of the resonance circuit is set smaller than a width of the first antenna element on a side of the resonance circuit, which is connected to the circuit board.

According to this configuration, even though the electronic parts containing the metal comes close to the plate-like conductors constituting the monopole antenna when two cases are closed, no degradation in gain is caused because a distance can be ensured by changing a width of the plate-like conductor element of the monopole antenna. Therefore, the antenna elements can be fitted to an inside of the case without an increase in size of the case.

Also, the portable radio apparatus of the present invention includes the type in which the electronic parts containing the metal comes close to the open end side of the monopole antenna when the first case and the second case are in their closed state.

Also, the portable radio apparatus of the present invention is constructed by providing the resonance circuit, which cuts off a predetermined frequency, in a middle of the element of the monopole antenna, and includes the type in which widths of the elements of the monopole antenna are set in front of and at the rear of the inserted resonance circuit, which cuts off a predetermined frequency, such that a width of the element that comes close to the electronic parts containing the metal in the closed state is constructed narrower than a width of the element that does not come close to the electronic parts containing the metal in the closed state.

According to this configuration, this portable radio apparatus can deal easily with a multi-band operation that makes it possible to transmit/receive a radio wave at a plurality of frequencies.

Also, the portable radio apparatus of the present invention includes the type in which the monopole antenna is connected to an end portion of the first circuit board on the opposite side to the joining portion.

Also, according to another aspect, the present invention provides an antenna unit applied to a portable radio apparatus, includes a circuit board, and a monopole antenna having a resonance circuit, which is connected to the circuit board to cut off a predetermined frequency, in the middle in the longitudinal direction. Here, the monopole antenna operates as a monopole antenna responding to a first frequency band, a first antenna element connected constituting the monopole antenna and arranged on the side, which is connected to the circuit board, of the resonance circuit operates as a monopole antenna responding to a second frequency band, and a width of a second antenna element arranged on the open end side of the resonance circuit is set smaller than a width of the first antenna element.

ADVANTAGES OF THE INVENTION

According to the antenna unit and the portable radio apparatus using this antenna unit of the present invention, a reduction in the antenna performance can be prevented even though the electronic parts in the case comes close to the conductor elements constituting the antenna when the case is folded, also the conductor elements constituting the antenna can be fitted into the inside of the case not to increase a size of the case, and also a reduction in the antenna performance caused due to the approach of the electronic parts containing the metal can be prevented.

DESCRIPTION OF REFERENCE NUMERALS

Figure 1A:
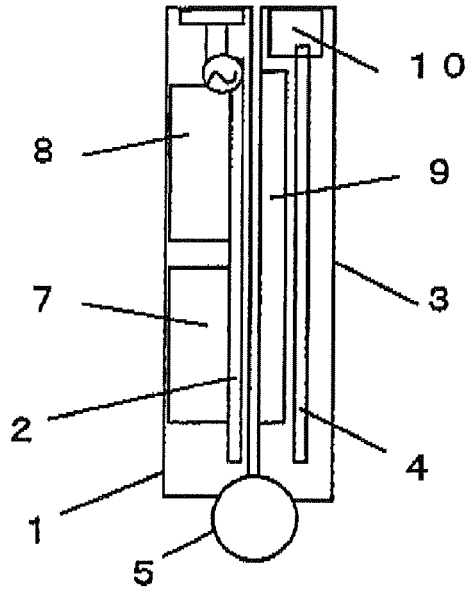
FIG. 1 A view showing a configuration of a portable radio apparatus according to an embodiment of the present invention, wherein (a) is a side view and (b) is a perspective view.

1 first case
2 first circuit board
3 second case
4 second circuit board
5 hinge
6 monopole antenna
7 battery portion
8 circuit portion
9 displaying portion
10 electronic parts
11 antenna element (first antenna element)
12 antenna element (second antenna element)
13 resonance circuit

BEST MODE FOR CARRYING OUT THE INVENTION

Figure 1B:
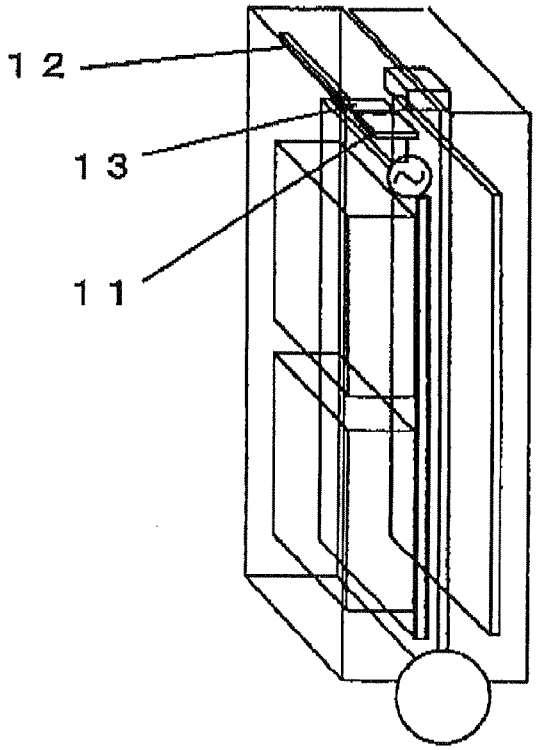

An antenna unit and a portable radio apparatus according to an embodiment of the present invention will be explained with reference to the drawings hereinafter. First, a basic configuration of a portable radio apparatus according to the present invention will be explained hereinafter. FIG. 1 shows a configuration of the portable radio apparatus according to the embodiment of the present invention.

In FIG. 1, the portable radio apparatus is constructed by the first circuit board 2 provided to the inside of the first case 1, a second circuit board 4 provided to the inside of the second case 3, the hinge (joining portion) 5, the monopole antenna consisting of the element 11 and the element 12 provided in the first case 1, a battery portion 7, a circuit portion 8, a displaying portion 9 provided in the second case 3 and constructed by the liquid crystal display, or the like, and the electronic parts 10 containing a metal. The first circuit board 2 and the second circuit board 4 are connected by a flexible substrate or a coaxial cable passing through the hinge 5. Also, the first case 1 containing the first circuit board 2 and the second case 3 containing the second circuit board 4 are joined turnably by the hinge 5. Thus, the portable radio apparatus is constructed.

Figure 12A:
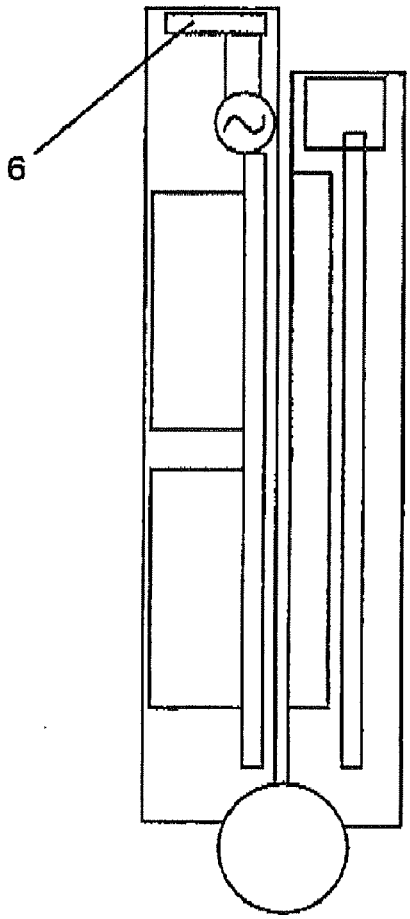
FIG. 12 A view showing a configuration of still another portable radio apparatus in the prior art, wherein (a) is a side view, and (b) is a perspective view.
Figure 12B:
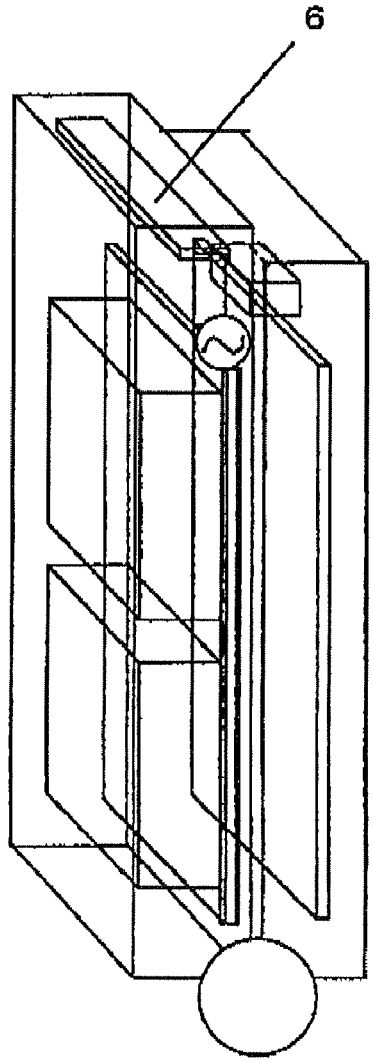

In the portable radio apparatus in FIG. 1, like the portable radio apparatus in FIG. 12, the folded monopole antenna consisting of the element (first antenna element) 11 on the power feed side and the element (second antenna element) 12 on the open end side is connected to one end of the first circuit board 2 on the opposite side to the hinge 5. The resonance circuit 13 for cutting off a predetermined frequency is inserted in the middle of the monopole antenna 6 in the longitudinal direction. In the portable radio apparatus, the antenna unit is constructed by the first circuit board 2, the element 11 on the power feed side, the element 12 on the open end side, and the resonance circuit 13.

In other words, in the portable radio apparatus of the present invention shown in FIG. 1, the monopole antenna is constructed by inserting the resonance circuit 13 that cuts off a predetermined frequency between the element 11 on the power feed side and the element 12 on the open end side. Also, respective elements of the monopole antenna are set in front and at the rear of the inserted resonance circuit 13 that cuts off a predetermined frequency such that a width of the open end side element 12 that comes close to the electronic parts 10 containing the metal when the case is closed is smaller than a width of the power feed side element 11 that does not come close to the electronic parts 10 containing the metal when the case is closed.

According to this configuration, the high-gain antenna capable of handling a wide band can be accomplished not to bring the antenna elements constituting the monopole antenna close to the electronic parts arranged in the second case and containing the metal when the first case 1 and the second case 3 are closed or not to extend a length of the first case.

EMBODIMENT

Figure 2:
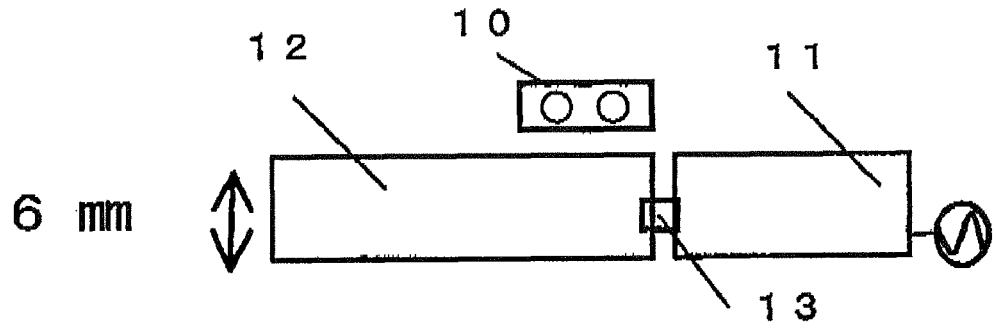
FIG. 2 A view showing a configuration of antenna elements in such a way that only an antenna portion in FIG. 12 is enlarged when a case is viewed along the top end direction on the opposite side to a hinge in a situation that a first case and a second case are folded.

The antenna characteristic of the antenna in the portable radio apparatus in FIG. 12 and FIG. 1 will be explained based on experimental results hereunder respectively. A sectional view showing a configuration of antenna elements in such a way that only an antenna portion in FIG. 12 is enlarged when the case is viewed along the top end direction on the opposite side to the hinge in a situation that a first case and a second case are folded is shown in FIG. 2.

The operational principle of this configuration of antenna elements will be given as follows. Since the resonance circuit 13 that cuts off a predetermined frequency is inserted in the middle of the element, a low frequency is cut off during the operation at a high frequency, e.g., a frequency in 1.7 GHz to 2.2 GHz (second frequency band), and thus an element length when viewed from the power feed portion is cut off by the resonance circuit 13 during a high frequency operation. As a result, this antenna configuration is operated in a short element length condition while using only the element 11 and produces the resonance at 1.7 GHz to 2.2 GHz. Also, since the resonance circuit 13 that cuts off a predetermined frequency passes a low frequency, e.g., a frequency in 800 MHz to 1 GHz (first frequency band), an element length when viewed from the power feed portion is equivalent to a total length of the element 11 and the element 12. As a result, this antenna configuration is operated in a long element length condition and resonates with a low frequency from 800 MHz to 1 GHz.

With the above, the antenna configuration in FIG. 12 can produce two resonance states or more and can handle a multi-band operation.

However, according to this configuration, it is understood that, when the monopole antennas 11, 12 are arranged in the first case 1, the antenna element 12 comes close to the electronic parts 10 containing the metal arranged in the second case 2 in the folded condition, for example.

Figure 3:
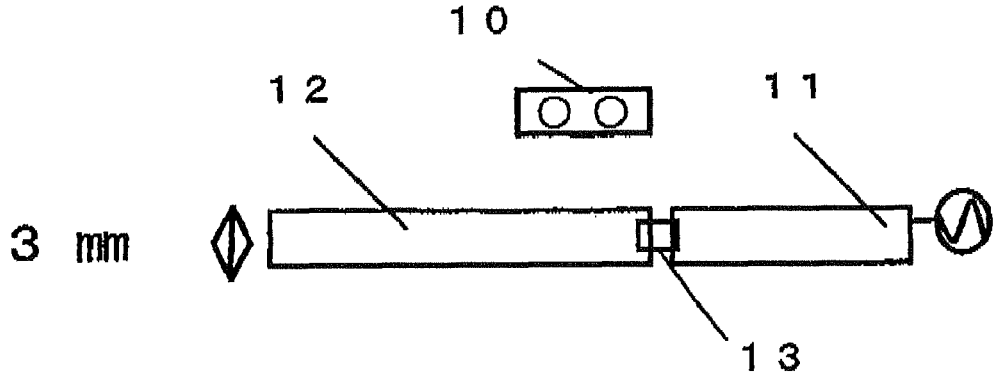
FIG. 3 A view showing a configuration of antenna elements when the antenna element in FIG. 2 is made narrow to 3 mm.
Figure 4:
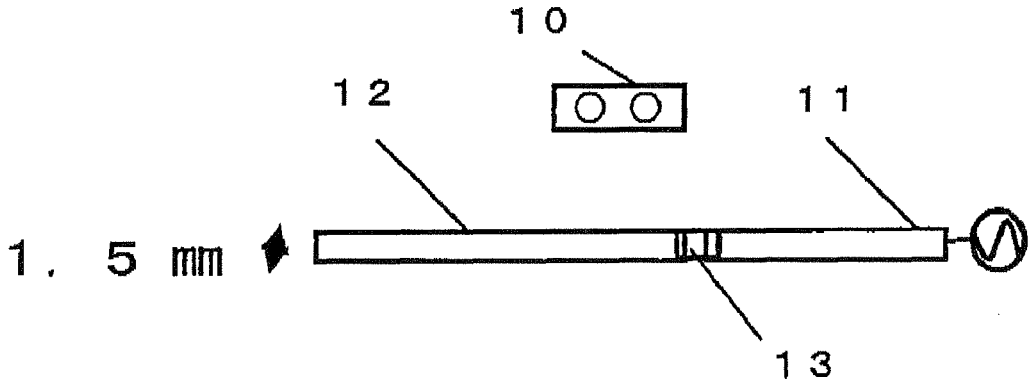
FIG. 4 A view showing a configuration of antenna elements when the antenna element in FIG. 2 is made narrow to 1.5 mm.
Figure 5:
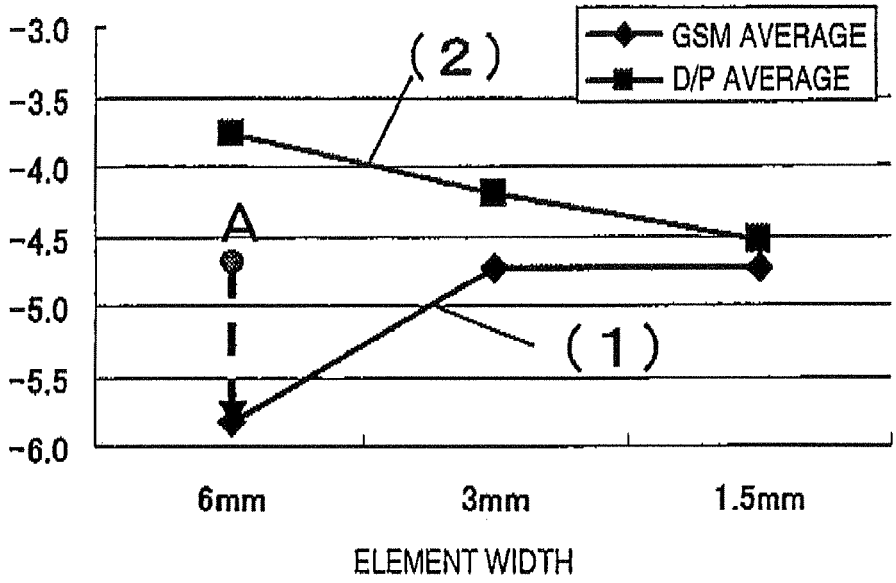
FIG. 5 A graph showing the antenna characteristic when the antenna elements in FIG. 2 to FIG. 4 are made narrow gradually.

FIG. 5 shows a relationship between an antenna element width and a free space efficiency and shows the antenna characteristic obtained when a width of the antenna elements is changed in accordance with the width of the antenna elements shown in FIG. 2 to FIG. 4. According to this antenna characteristic, an antenna efficiency is $\eta=-4.7$ dB at a point A when the electronic parts 10 containing the metal does not exist, while an antenna efficiency is $\eta=-5.8$ dB at an element width of 6 mm in FIG. 5. Thus, it is understood that the antenna efficiency is lowered by about 1.1 dB because of the approach of electronic parts.

A configuration of antenna elements when a width of the antenna elements is reduced to prevent a reduction caused by the approach of the electronic parts 10 containing the metal to the antenna element is shown in FIG. 3 and FIG. 4. For example, a configuration of antenna elements when a width of the antenna element is reduced to 1.5 mm is shown in FIG. 4. This configuration positions the neighboring portion away from the electronic parts 10 containing the metal.

From FIG. 5 that shows the antenna efficiency characteristic when a width of the antenna element is made narrow sequentially from FIG. 2 to FIG. 4, it is understood that the antenna efficiency is improved in a frequency band of 880 to 960 MHz indicated by (1). However, the antenna efficiency characteristic in 1710 to 1990 MHz as a high frequency indicated by (2) is degraded by about 0.8 dB from −3.7 dB at a width of 6 mm to −4.5 dB at a width of 1.5 mm. The reason for this is given as follows. A current flows through the antenna element 12 on the open end side as well as the antenna element 11 on the power feed side at a frequency of 880 to 960 MHz, and the current is spread widely to include the first circuit board 2. Thus, the antenna configuration is not affected by a reduction in width of the element, and also a frequency band can be kept. Therefore, the antenna efficiency characteristic is improved to the extent that the antenna configuration is distant from the electronic parts 10 containing the metal. In contrast, the antenna configuration is operated by the element 11 on the power feed side in a frequency band of 1.7 GHz to 2.2 GHz, and the current is concentrated on this element. Therefore, when this element is made narrow, a frequency band is narrowed and also the antenna efficiency characteristic is degraded.

Figure 13A:
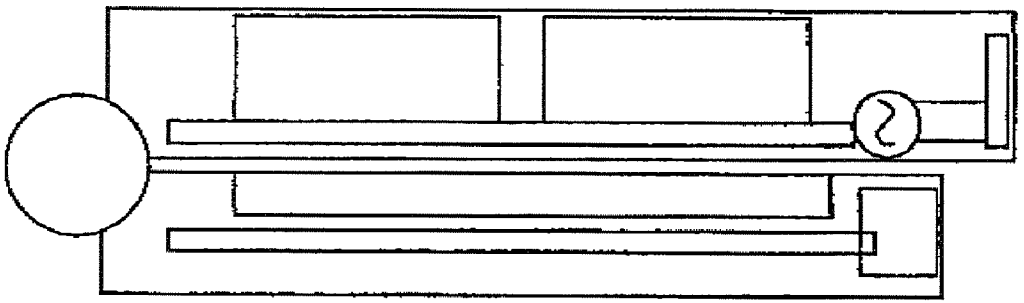
FIG. 13 A view showing a configuration of yet still another portable radio apparatus in the prior art, wherein (a) is a side view, and (b) is a perspective view.
Figure 13B:
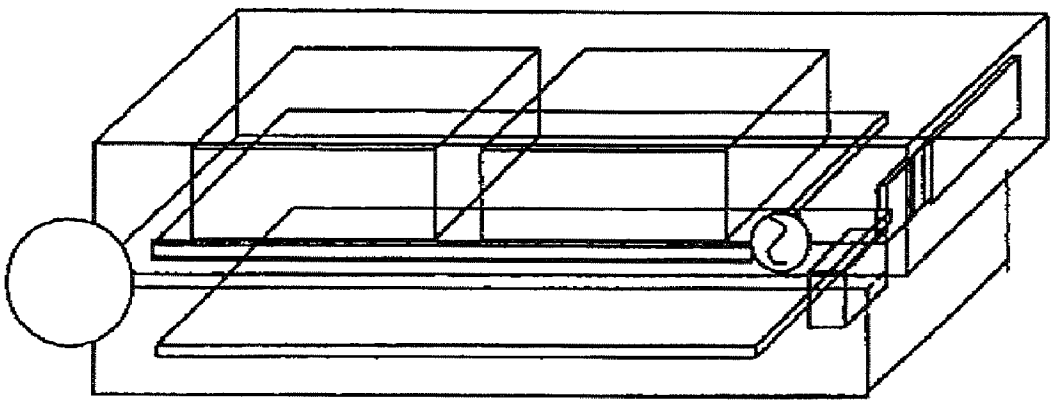

In order to prevent this degradation, as shown in FIG. 13, there is a method of creating a space enough to prevent the approach of the element 11 to the electronic parts 10 arranged in the second case 3 and containing the metal when the case is folded, in the first case 1. However, a space must be kept in the case, and thus such a problem arises that a size of the case is increased, as described above.

Figure 6:
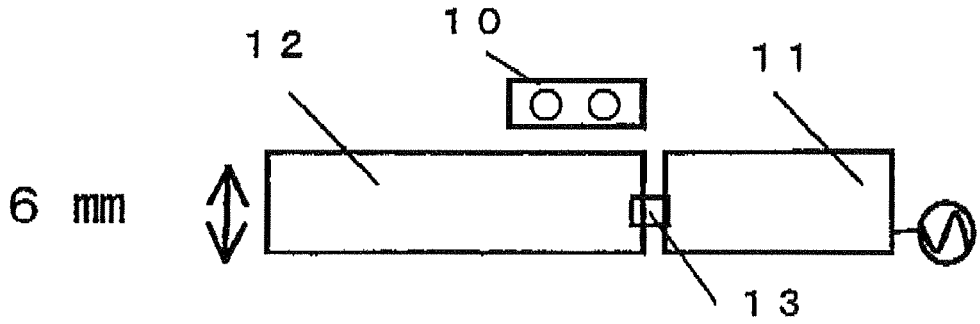
FIG. 6 A view showing a configuration of antenna elements in such a way that only an antenna portion in FIG. 1 is enlarged when a case is viewed along the top end direction on the opposite side to a hinge in a situation that a first case and a second case are folded.
Figure 7:
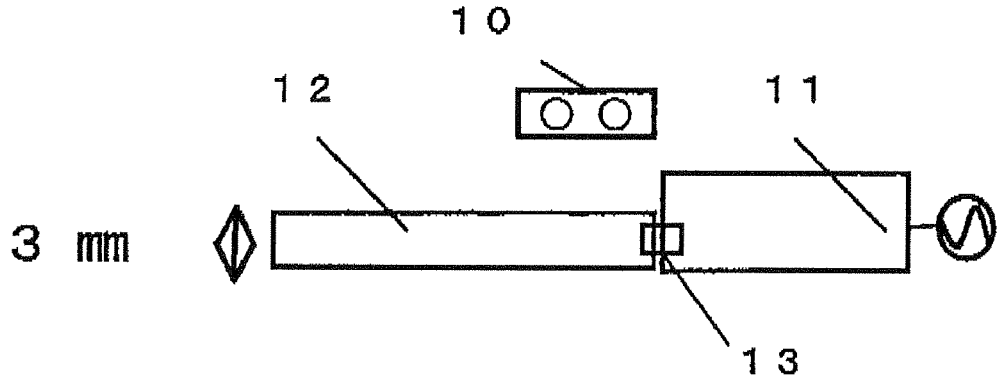
FIG. 7 A view showing a configuration of antenna elements when the element on the open end side in FIG. 6 is made narrow to 3 mm.
Figure 8:
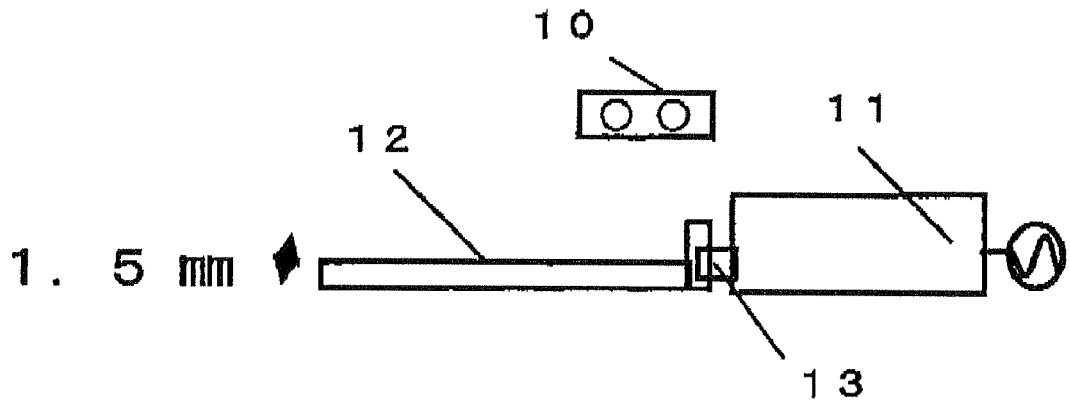
FIG. 8 A view showing a configuration of antenna elements when the element on the open end side in FIG. 6 is made narrow to 1.5 mm.
Figure 9:
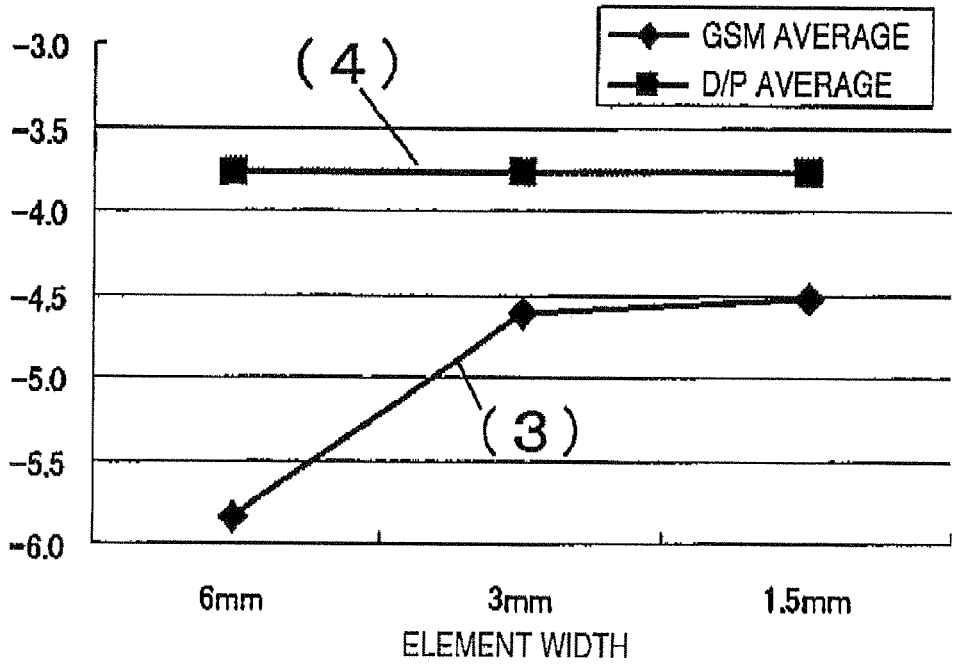
FIG. 9 A graph showing the antenna characteristic when the elements in FIG. 6 to FIG. 8 are made narrow gradually.
Figure 10A:
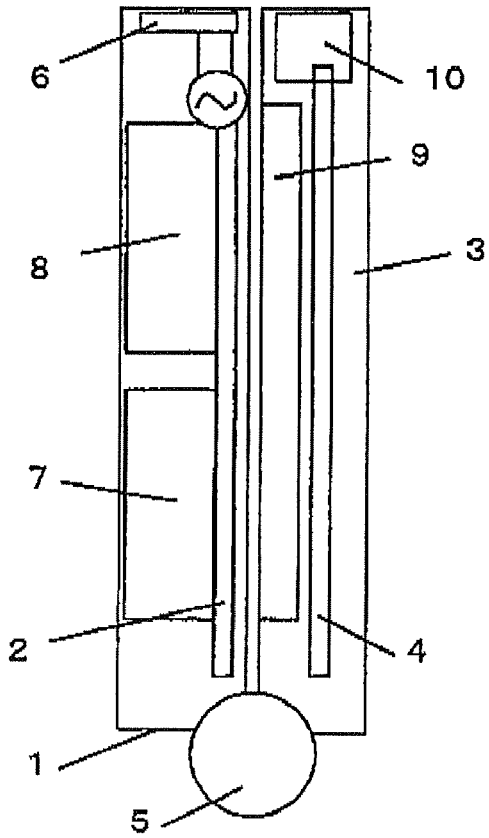
FIG. 10 A view showing a configuration of a portable radio apparatus in the prior art, wherein (a) is a side view, and (b) is a perspective view.
Figure 10B:
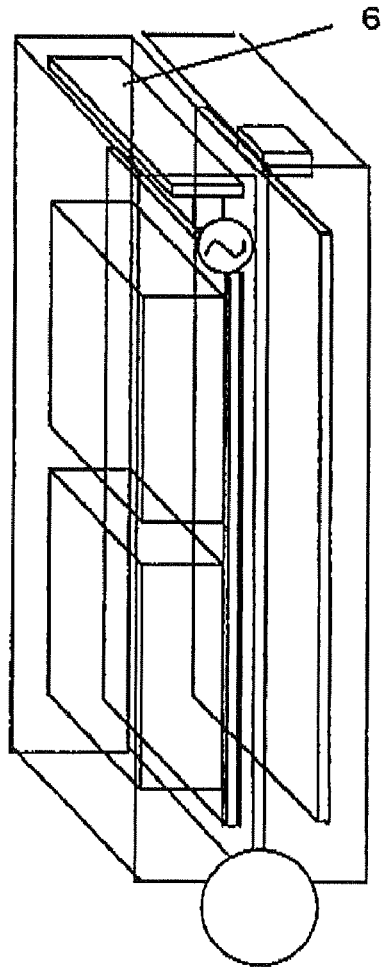
Figure 11A:
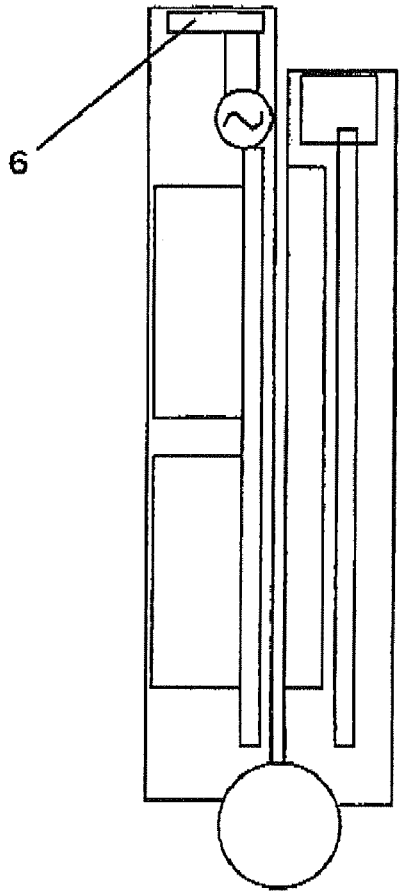
FIG. 11 A view showing a configuration of another portable radio apparatus in the prior art, wherein (a) is a side view, and (b) is a perspective view.
Figure 11B:
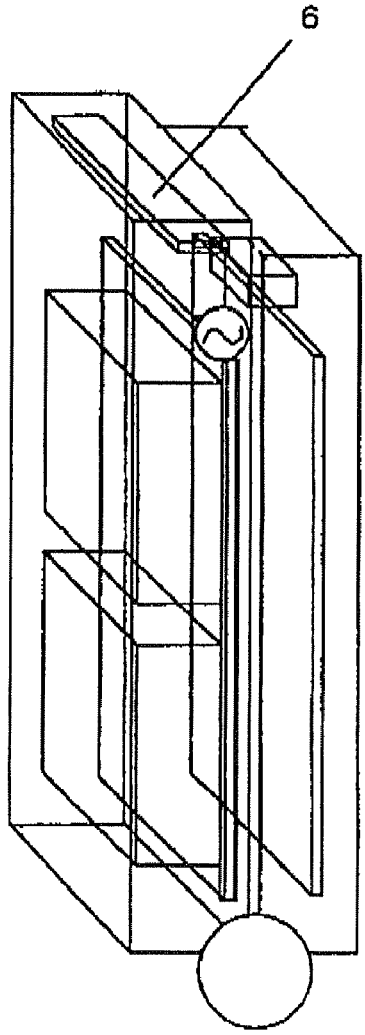

In contrast, the portable radio apparatus of the present invention shown in FIG. 1 is constructed such that the resonance circuit 13 that cuts off a predetermined frequency is inserted in the middle between the element 11 and the element 12 constituting the monopole antenna. Here, two elements arranged in front of and at the rear of the resonance circuit 13 that cuts off a predetermined frequency respectively are designed to have different widths. That is, a width of the open end side element 12 that comes close to the electronic parts 10 containing the metal in the folded condition is constructed smaller than a width of the power feed side element 11 that does not come close to the electronic parts 10 containing the metal in the folded condition (the element 12 is narrower than the element 11). A configuration of antenna elements when only a width of the element 12 is changed is shown in FIG. 6 to FIG. 8 respectively, and the antenna efficiency characteristic is shown in FIG. 9. It is understood that, unlike that in FIG. 5, the antenna efficiency characteristic in 1710 to 1990 MHz indicated by (4) in FIG. 9 is not degraded. It is understood that the characteristic in 880 to 960 MHz indicated by (3) in FIG. 9 is also improved.

With such arrangement, a reduction of the antenna efficiency caused when a width of the power feed side element 11 on which the current concentrates and which is operated in a frequency bane of 1.7 GHz to 2.2 GHz is reduced is not brought about, nevertheless a distance from the electronic parts 10 containing the metal can be ensured.

The antenna obtained by the present configuration can keep a sufficient space in the first case 1, as shown in FIG. 13, in a frequency band of 800 MHz to 1 GHz and a frequency band of 1.7 GHz to 2.2 GHz such that the antenna element does not come close to the electronic parts 10 arranged in the second case 3 and containing the metal in the folded condition, does not increase a size of the case, does not cause a reduction of a free space efficiency even when the electronic parts 10 containing the metal exists, and can ensure the good antenna characteristic.

As described above, according to the portable radio apparatus of the embodiment of the present invention, such a situation can be avoided effectively that, when the first case 1 and the second case 3 are folded, the antenna elements constituting the monopole antenna 6 come close to the electronic parts 10 arranged in the second case 3 and containing the metal. Also, the antenna performance can be improved rather than the portable radio apparatus in the prior art without extension of a length of the first case 1.

Also, as the portable radio apparatus in which the resonance circuit that cuts off a predetermined frequency is provided in the middle of the element, the mobile radio equipment in which the electronic parts containing the metal is installed into the first case, and a width of a portion of the monopole antenna positioned close to the electronic parts containing the metal is set on the power feed side and the open end side of the resonance circuit inserted to cut off a predetermined frequency such that a width of the element on the open end side positioned close to the electronic parts containing the metal is made narrow rather than a width of the element not positioned close to the electronic parts containing the metal at a neighboring area of the electronic parts may be employed.

Also, the monopole antenna may be arranged on the hinge side of the case. Also, the antenna unit and the portable radio apparatus of the present invention can be applied to various mobile information terminals such as a cellular phone, PHS, and the like. Also, the advantages of the present invention can be achieved if the influence of the electronic parts 10 can be reduced by setting a width of at least a portion of the element 12 on the open end side smaller than a width of the element 11 on the power feed side. Also, it is not essential to the present invention that, as shown in FIG. 7, a width of the element 12 on the open end side should be set smaller than a width of the element 11 on the power feed side over a full length of the element 12.

With the above, the embodiment of the present invention is explained, but the present invention is not limited to the matters given in the above embodiment. Variations and adaptations made by those skilled in the art based on the description of the specification and the well-known technologies are acceptable to the present invention, and are contained in a scope within which a protection is sought.

This application is based upon Japanese Patent Application (Patent Application No. 2005-047487) filed on Feb. 23, 2005; the contents of which are incorporated herein by reference.

INDUSTRIAL APPLICABILITY

As described above, according to the antenna unit of the present invention and the portable radio apparatus using this antenna unit, the plate-like antenna elements constituting the antenna can be fitted in the case while preventing such a situation that the antenna elements come close to the neighboring substance such as the electronic parts. Therefore, the antenna performance can be improved.

The invention claimed is:

1. An antenna unit applied to a portable radio apparatus, comprising:

a circuit board; and a monopole antenna having a first antenna element and a second antenna element both extending in a longitudinal direction of the monopole antenna, each of the first and second antenna elements having a width that extends perpendicularly to the longitudinal direction, the monopole antenna further having a resonance circuit in a middle in the longitudinal direction between the first and second antenna elements, the resonance circuit being connected to the circuit board and configured to cut off a predetermined frequency, wherein the monopole antenna operates as a monopole antenna which responds to a first frequency band;

wherein the first antenna element, which constitutes the monopole antenna and is positioned on a connection end side of the resonance circuit, to be connected to the circuit board, operates as a monopole antenna which responds to a second frequency band, and the width of the second antenna element on an open end side of the resonance circuit is set smaller than the width of the first antenna element.

2. A portable radio apparatus, comprising:

a first case;

a second case;

a joining portion which joins the first case and the second case relatively movably;

a circuit board which is provided inside of the first case; and a monopole antenna having a first antenna element second antenna element both extending in a longitudinal direction of the monopole antenna, each of the first and second antenna elements having a width that extends perpendicularly to the longitudinal direction, the monopole antenna further having a resonance circuit in a middle in the longitudinal direction between the first and second antenna elements, the resonance circuit being connected to the circuit board and configured to cut off a predetermined frequency, wherein the width of the second antenna element on an open end side of the resonance circuit is set smaller than the width of the first antenna element on a connection end side of the resonance circuit to be connected to the circuit board.

3. The portable radio apparatus according to claim 2, wherein the monopole antenna is a plate-like monopole antenna.

4. The portable radio apparatus according to claim 2, wherein the monopole antenna is connected to an end portion of the first case on an opposite side to the movable joining portion which joins the first case and the second case.

5. The portable radio apparatus according to claim 3, wherein the electronic part containing the metal is mounted on a circuit board provided inside of the second case.

6. The portable radio apparatus according to claim 3, wherein the monopole antenna is connected to an end portion of the first case on an opposite side to the movable joining portion which joins the first case and the second case.

7. A portable radio apparatus, comprising:

a first case;

a second case;

a joining portion which joins the first case and the second case relatively movably;

a circuit board which is provided inside of the first case; and a monopole antenna having a first antenna element and a second antenna element both extending in a longitudinal direction of the monopole antenna, each of the first and second antenna elements having a width that extends perpendicularly to the longitudinal direction, the monopole antenna further having a resonance circuit in a middle in the longitudinal direction between the first and second antenna elements, the resonance circuit being connected to the circuit board and configured to cut off a predetermined frequency, wherein the monopole antenna operates as a monopole antenna which responds to a first frequency band;

wherein the first antenna element, which constitutes the monopole antenna and is positioned on a connection end side of the resonance circuit to be connected to the circuit board, operates as a monopole antenna that responds to a second frequency band; and wherein the width of the second antenna element on an open end side of the resonance circuit is set smaller than the width of the first antenna element.

8. The portable radio apparatus according to claim 7, wherein the monopole antenna is a plate-like monopole antenna.

9. The portable radio apparatus according to claim 7, wherein the monopole antenna is connected to an end portion of the first case on an opposite side to the movable joining portion which joins the first case and the second case.

10. A portable radio apparatus, comprising:

a first case;

a second case;

a joining portion which joins the first case and the second case relatively movably;

a circuit board which is provided inside of the first case;

a monopole antenna having a resonance circuit in a middle in a longitudinal direction thereof, the resonance circuit being connected to the circuit board and configured to cut off a predetermined frequency; and an electronic part which is arranged in the second case and which contains a metal, wherein, in a configuration such that the electronic part containing the metal comes close to a second antenna element constituting the monopole antenna on an open end side of the resonance circuit when the first case and the second case are set in a closed state, a width of the second antenna element is set smaller in an area which comes close to the electronic part containing the metal than a width of a first antenna element on a connection end side of the resonance circuit to be connected to the circuit board.

11. The portable radio apparatus according to claim 10, wherein the electronic part containing the metal is mounted on a circuit board provided inside of the second case.

12. The portable radio apparatus according to claim 10, wherein the monopole antenna is a plate-like monopole antenna.

13. The portable radio apparatus according to claim 10, wherein the monopole antenna is connected to an end portion of the first case on an opposite side to the movable joining portion which joins the first case and the second case.

14. A portable radio apparatus, comprising:

a first case;

a second case;

a joining portion which joins the first case and the second case relatively movably;

a first circuit board which is provided inside of the first case;

a monopole antenna having a resonance circuit in a middle in a longitudinal direction thereof, the resonance circuit being connected to the circuit board and configured to cut off a predetermined frequency; and an electronic part which is arranged in the first case and which contains a metal;

wherein, out of a first antenna element constituting the monopole antenna on a connection end side of the resonance circuit to be connected to the circuit board, and a second antenna element on an open end side, a width of the antenna element which comes close to the electronic part containing the metal when the first case and the second case are in a closed state is set smaller than a width of the other antenna element on a side which does not come close to the electronic part containing the metal.

15. A portable radio apparatus, comprising:

a first case;

a second case;

a joining portion which joins the first case and the second case relatively movably;

a circuit board which is provided inside of the first case;

a monopole antenna having a resonance circuit in a middle in a longitudinal direction thereof, the resonance circuit being connected to the circuit board and configured to cut off a predetermined frequency, the monopole antenna further having a first antenna element provided on a connection end side of the resonance circuit to be connected to the circuit board and a second antenna element provided on an open end side of the resonance circuit; and an electronic part which is arranged in the second case and which contains a metal, wherein, when the first case and the second case are set in a closed state, a distance between the electronic part containing the metal and the first antenna element is longer than a distance between the electronic part containing the metal and the second antenna element, and a width of the first antenna element is set larger than a width of the second antenna element.

* * * * *

UNITED STATES PATENT AND TRADEMARK OFFICE

CERTIFICATE OF CORRECTION

PATENT NO. : 7,876,271 B2
APPLICATION NO. : 11/816913
DATED : January 25, 2011
INVENTOR(S) : Hideo Nakanishi et al.

It is certified that error appears in the above-identified patent and that said Letters Patent is hereby corrected as shown below:

Title Page, Item 75
"Hideo Nakanishi, Yokohama (JP); Takashi Aoki, Kadoma (JP)" should read, --Hideo Nakanishi, Kanagawa (JP); Takashi Aoki, Okayama (JP)--.

Column 8, Line 26
"a monopole antenna having a first antenna element second" should read, --a monopole antenna having a first antenna element and a second--.

Column 8, Line 48
"The portable radio apparatus according to claim 3," should read, --The portable radio apparatus according to claim 15,--.

Signed and Sealed this
Tenth Day of May, 2011

David J. Kappos
*Director of the United States Patent and Trademark Office*